US005875510A

United States Patent [19]

Lamond et al.

[11] Patent Number: 5,875,510

[45] Date of Patent: Mar. 2, 1999

[54] REPLACEABLE HEAD TOOTHBRUSH

[75] Inventors: Donald Lamond, Lynbrook, N.Y.; Bert Heinzelman, Tenafly, N.J.; John Moldauer, Brooklyn, N.Y.

[73] Assignee: Chesebrough-Pond's USA Co., Division of Conopco, Inc., Greenwich, Conn.

[21] Appl. No.: 864,874

[22] Filed: May 20, 1997

Related U.S. Application Data

[60] Provisional application No. 60/026,845 Sep. 27, 1996.

[51] Int. Cl.[6] ..... A46B 9/04

[52] U.S. Cl. ..... 15/167.1; 15/176.6

[58] Field of Search ..... 15/145, 167.1, 15/176.1, 176.6; 403/20, 321, 322.1, 326, 329

[56] References Cited

U.S. PATENT DOCUMENTS

| | | | |
|---|---|---|---|
| D. 378,250 | 3/1997 | Marchello . | |
| 3,072,938 | 1/1963 | Phaneuf | 15/176.6 |
| 3,081,783 | 3/1963 | Miller . | |
| 3,181,189 | 5/1965 | Leyden | 15/145 |
| 3,927,435 | 12/1975 | Moret et al. | 403/322.1 |
| 4,227,276 | 10/1980 | Ginsberg et al. | 15/176.1 |
| 4,683,604 | 8/1987 | Rueb . | |
| 5,224,234 | 7/1993 | Aesenault et al. . | |
| 5,247,718 | 9/1993 | Victorian . | |
| 5,253,948 | 10/1993 | Butler | 15/176.6 |
| 5,369,835 | 12/1994 | Clarke | 15/176.1 |
| 5,398,369 | 3/1995 | Heinzelman et al. . | |
| 5,435,037 | 7/1995 | Ledingham . | |
| 5,471,701 | 12/1995 | Parfenie | 15/167.1 |
| 5,511,276 | 4/1996 | Lee . | |
| 5,564,152 | 10/1996 | Jeannet et al. . | |

FOREIGN PATENT DOCUMENTS

| | | |
|---|---|---|
| 2 624 766 | 12/1987 | France . |
| 959062 | 8/1994 | South Africa . |
| 95/20339 | 8/1995 | WIPO . |

*Primary Examiner*—Terrence Till
*Attorney, Agent, or Firm*—Milton L. Honig

[57] ABSTRACT

A replaceable head toothbrush is described having a handle, a brushhead and a collar. The handle is formed with a cavity within which the collar is insertable. The brushhead at an end thereof is formed with a neck having a coupling anchor for engaging a complementary disengaging mechanism within the collar.

10 Claims, 3 Drawing Sheets

REPLACEABLE HEAD TOOTHBRUSH

CROSS-REFERENCE TO RELATED APPLICATIONS

This application derives priority under 35 U.S.C. § 119(e) from Provisional application Ser. No. 60/026,845 filed Sep. 27, 1996.

BACKGROUND OF THE INVENTION

1. Field of the Invention

The invention concerns a toothbrush with a replaceable head upon which the bristles are supported.

2. The Related Art

Improved oral hygiene is promoted through toothbrush replacement at least every few weeks. This practice greatly reduces germ accumulation and transmission from bacteria-encrusted bristles. Moreover, bristles do become worn and softened, thus losing their cleaning effectiveness. A cost-effective alternative to purchase of a new toothbrush is replacement only of the cleaning bristle portion. The art has vigorously pursued this concept.

U.S. Pat. No. 5,247,718 (Victorian) reports disposable bristles in the form of an insert snappable into and out of an aperture of a toothbrush head. An elongated U-shaped clip is hingedly connected to the head opposite the handle for maintaining the insert in a gripping relationship.

U.S. Pat. No. 4,683,604 (Rueb) describes a toothbrush wherein the front end face of the handle has a flat projection receivable in a complementary socket within an adjacent end face of a detachable bristle carrier. The projection is integral with an arrowhead-shaped male detent. The latter is detachably snapped into a recess extending from the socket into that surface of the carrier from which the bristles extend.

U.S. Pat. No. 3,081,783 (Miller) discloses a fountain type toothbrush having a brush head and a detachable hollow handle. A pressurized supply of toothpaste is carried within the handle. The head is formed in two parts, each being held in assembled relation by a dovetail connection. A neck portion at one end of the toothbrush head is provided with oppositely extending pins that engage bayonet slots formed within a mating recess of the handle. A problem with this arrangement is the difficulty in separating the head from the handle.

U.S. Pat. No. 5,224,234 (Arsenault et al.) reports another type of replaceable toothbrush head. Along one end of the handle is a bristle assembly receptacle whose undersurface is dovetailed shaped to mate with a complementary shaped replaceable bristle assembly head. Retention is achieved via the dovetail groove and also a mating nib. The handle and bristle assembly head are secured to one another by friction and/or clamping action. Mere frictional and/or clamping engagement may often be insufficient to prevent undesirable separation when the toothbrush is in actual use.

U.S. Pat. No. 5,398,369 (Heinzelman et al.) describes a toothbrush with a special handle arrangement. This handle includes an elongated arm having a recess holding a pressure pad and a series of semi-ring shaped rubber gripping bands protruding from and circumscribing bottom and lateral surfaces of the arm. In the United States, the commercial embodiment of this toothbrush is sold under the Mentadent7 brand. A need has been identified for reducing the cost of this product while maintaining its excellent functionality. Use of a replaceable head addresses the cost factor while recyclability of the handle has environmental benefits. Of course, the challenge has been to engineer a replaceable head that still retains all the features of the original very popular Mentadent7 product.

Accordingly it is an object of the present invention to provide a toothbrush with a replaceable head essentially similar in outward appearance to that of the original Mentadent7 product.

Another object of the present invention is to provide a toothbrush with a replaceable head which when lockingly engaged with the handle is securely retained even under vigorous brushing of the teeth.

Yet another object of the present invention is to provide a toothbrush with a replaceable head that can readily be engaged and disengaged from its handle when so intended by the user.

A still further object of the present invention is to provide a toothbrush with a replaceable head having a simple coupling anchor which can be readily manipulated by children, grownups, senior citizens and even those having manipulative disabilities.

Yet still a further object of the present invention is to provide replaceable heads to serve as refills for attachment to a receiving handle.

SUMMARY OF THE INVENTION

A replaceable head toothbrush is provided including:

(i) a handle with a cavity at its first end;

(ii) a brushhead comprising a base, bristle tufts projecting from the base and a neck extending lengthwise from the base, the neck having a coupling anchor for engaging the handle, the neck having first and second ends with the coupling anchor terminating at the second end; and (iii) a collar with outer walls forming a hollow center and with a disengaging mechanism which lockingly receives the neck coupling anchor of the brushhead, and the collar being securingly lodged within the cavity at the first end of the handle.

In a preferred embodiment the neck coupling anchor includes a body portion with a pair of outwardly flexible wings. These wings are rectangular and connected to the body along one side of their rectangular structure. These wings flare outwardly from the second end of the neck toward the bristle tufts. A further feature of the neck is a nib utilized to properly orient the brushhead prior to locking of the neck relative to the collar and handle.

The complementary disengaging mechanism of the collar is embodied in a pair of outwardly flexible spring leaves. These leaves are rectangular and connected to the walls of the collar on only a single side. Each spring leaf includes a pin formed on an end thereof oriented at right angles to the leaf. The handle is provided with a pair of apertures traversing through the handle. Respective pins of the collar protrude through these apertures.

Also contemplated by the present invention are separate replaceable brushheads which are packaged and sold separately from the fully assembled toothbrush. The brushheads are intended to be packaged without a handle, preferably individually in a transparent package.

BRIEF DESCRIPTION OF THE DRAWING

The various objects, advantages and features of the present invention will best be understood in conjunction with the following detailed description and the accompanying drawing in which.

DETAILED DESCRIPTION OF THE INVENTION

Figure 1:
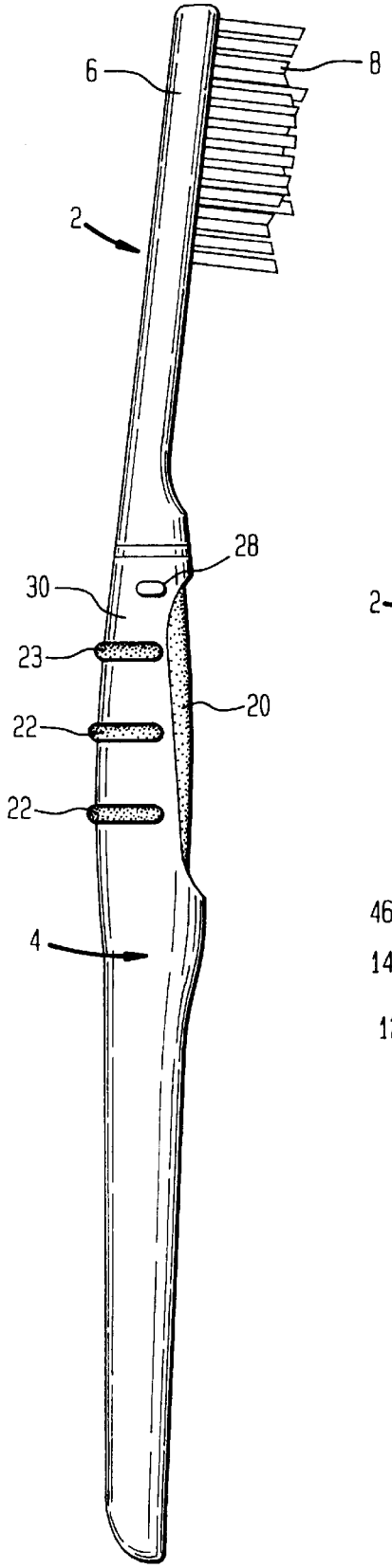
FIG. 1 is a side elevational view of a toothbrush according to the present invention.

According to this invention as shown in FIG. 1, the replaceable head toothbrush includes a brushhead 2 and a handle 4, the former including a base 6 from which bristle tufts 8 project.

Figure 2:
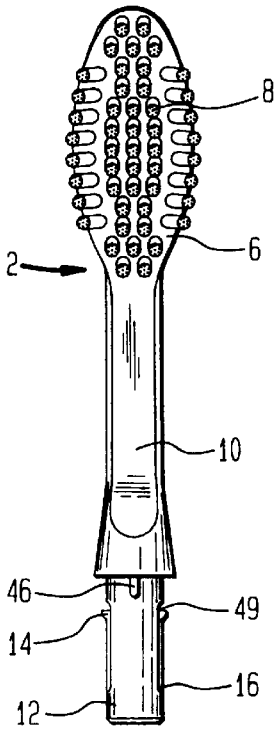
FIG. 2 is a top plan view of the replaceable head section of the embodiment shown in FIG. 1.
Figure 3:
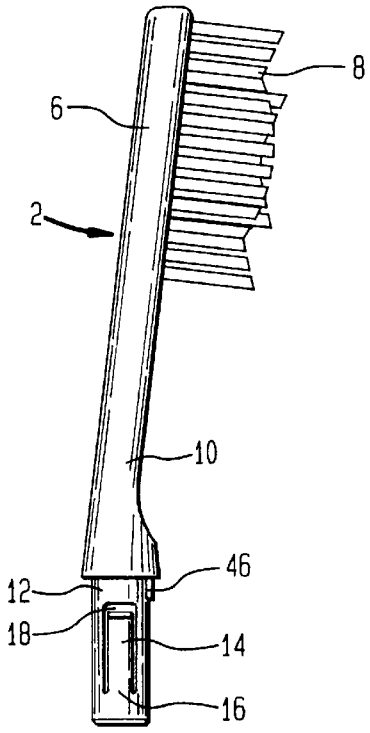
FIG. 3 is a side elevational view of the replaceable head shown in FIG. 2.

FIGS. 2 and 3 illustrate the brushhead 2 separated from the handle. Lengthwise extending from the base is a neck 10 having a coupling anchor for engaging the handle 4. The coupling anchor includes a body portion 12 and a pair of outwardly flexible wings 14. The wings 14 are rectangular in shape and connected to the body portion 12 on only one side 16 of the rectangular shape. As best shown in FIG. 2, wings 14 flare outwardly from the second end of the neck 10 toward the bristle tufts 8. FIG. 3 best illustrates a U-shaped groove 18 within body portion 12 which defines each of the rectangular wings 14.

Figure 4:
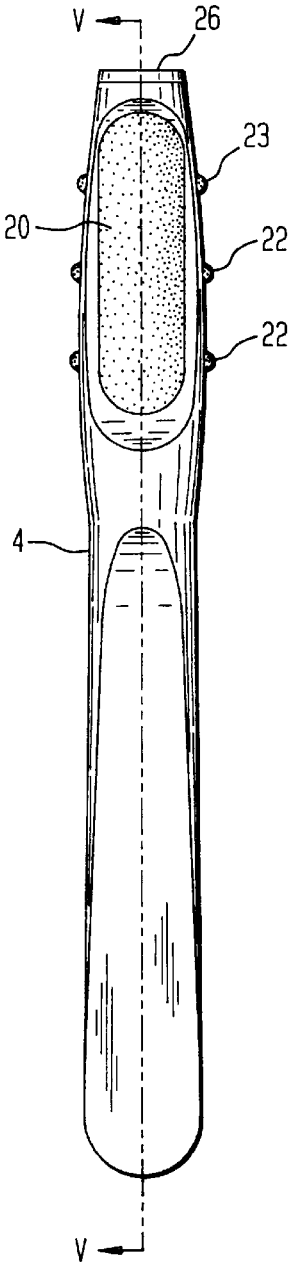
FIG. 4 is a top plan view of the handle absent the replaceable head, per the embodiment of FIG. 1.
Figure 5:
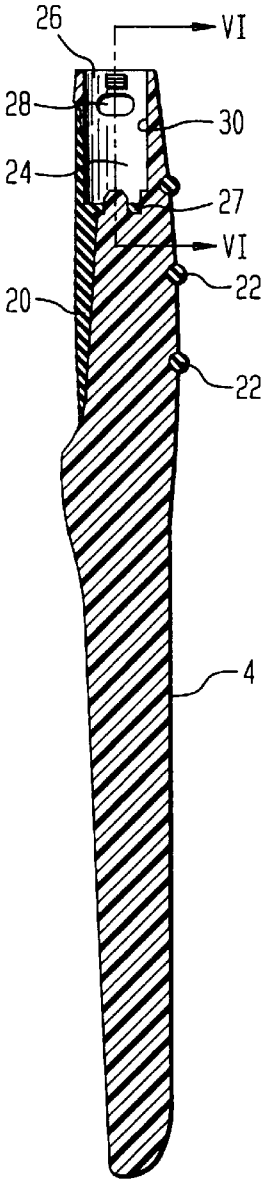
FIG. 5 is a cross-sectional view along line 5—5 of FIG. 4.
Figure 6:
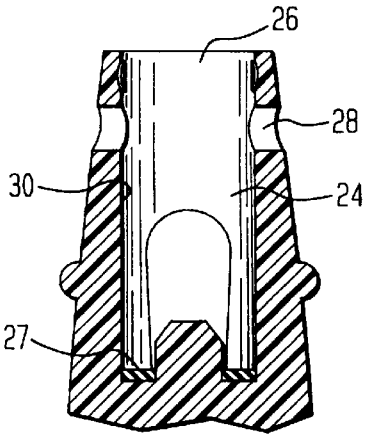
FIG. 6 is a cross-sectional enlarged view of a front portion of the handle taken along line 6—6 of FIG. 5.

FIG. 4 illustrates the handle 4 portion of the toothbrush which includes an elastomeric (rubber) pad 20, two elastomeric ribs 22, and a hard plastic third rib 23 integral with the hard plastic material of the handle. All three ribs protrude from and circumscribe bottom and lateral surfaces of the handle. FIG. 5 in cross-sectional view illustrates cavity 24 at its front or first end 26. An integrally molded elastomeric ring 27 is positioned at a closed end of cavity 24 and becomes compressed during assembly of the toothbrushhead 2 with the handle 4. Compression maintains these parts tightly together and eliminates any slack in the assembled toothbrush. A pair of apertures 28 traverse walls 30 of the handle. FIG. 6 best illustrates these features.

Figure 7:
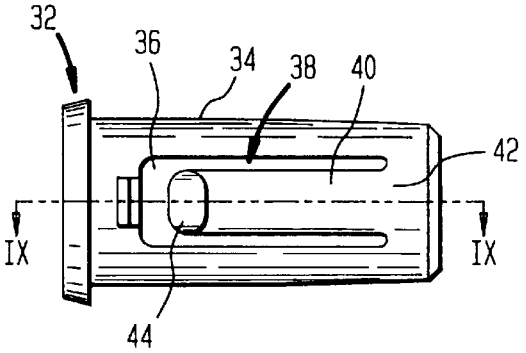
FIG. 7 is a side view of the collar separated from the toothbrush handle.
Figure 8:
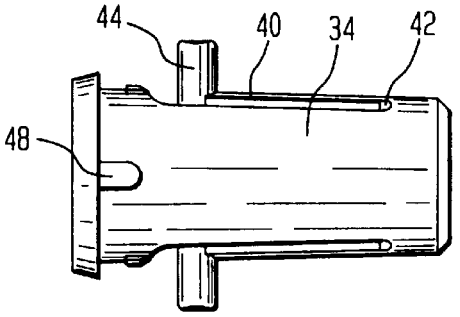
FIG. 8 is a front view of the collar shown in FIG. 7.
Figure 9:
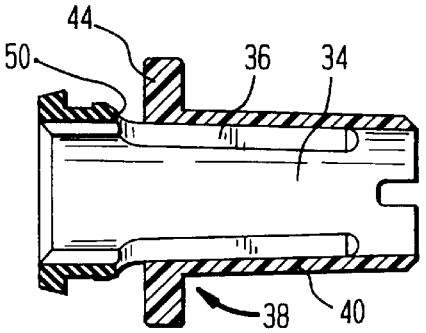
FIG. 9 is a cross-sectional view of the collar taken along 9—9 of FIG. 7.

Inserted within cavity 24 of the handle is a hollow collar 32. FIGS. 7–9 illustrate the collar as having outer walls 34 forming a hollow center 36 and a disengaging mechanism 38. Elements of the disengaging mechanism 38 include a pair of outwardly flexible spring leaves 40 being of rectangular shape. The leaves 40 are connected to the outer walls 34 of the collar on only a single side 42. Each spring leaf includes a pin 44 formed on an end thereof and oriented at right angles to the leaf.

When assembled, collar 32 fits snugly within cavity 24 of handle 4. Pins 44 of the collar are arranged to protrude through the apertures 28 of the handle.

Figure 10:
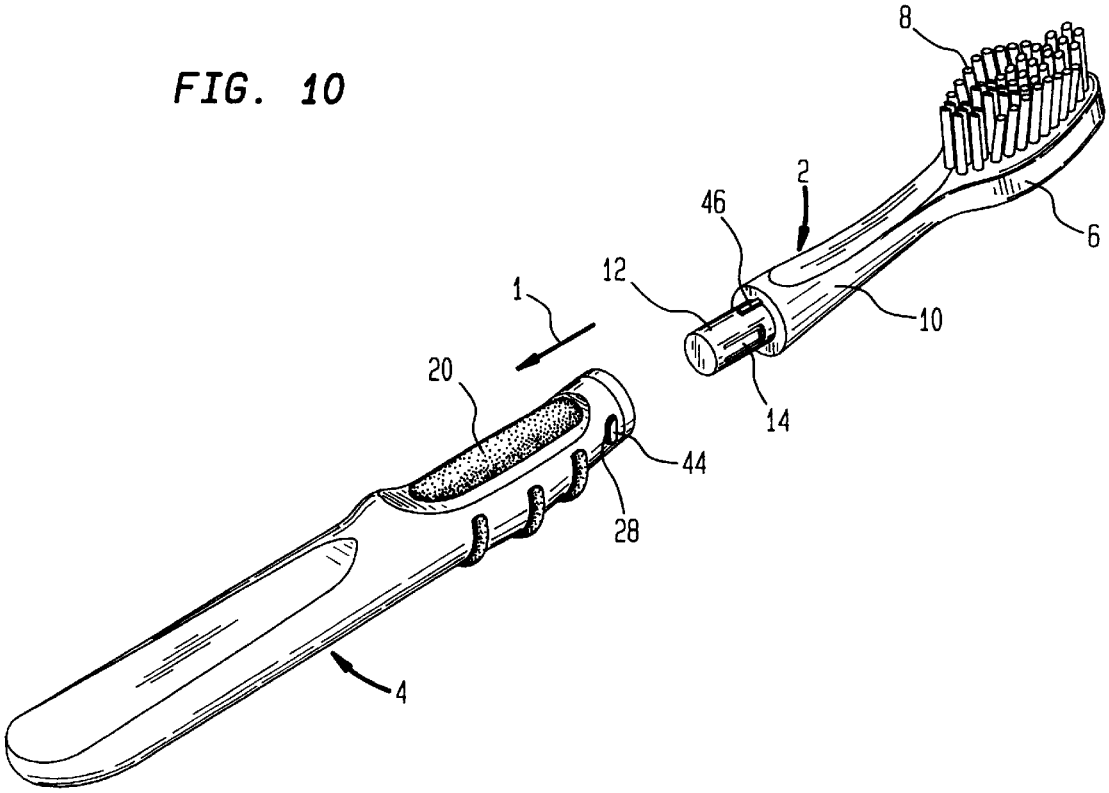
FIG. 10 demonstrates insertion of the replaceable head into the handle.
Figure 11:
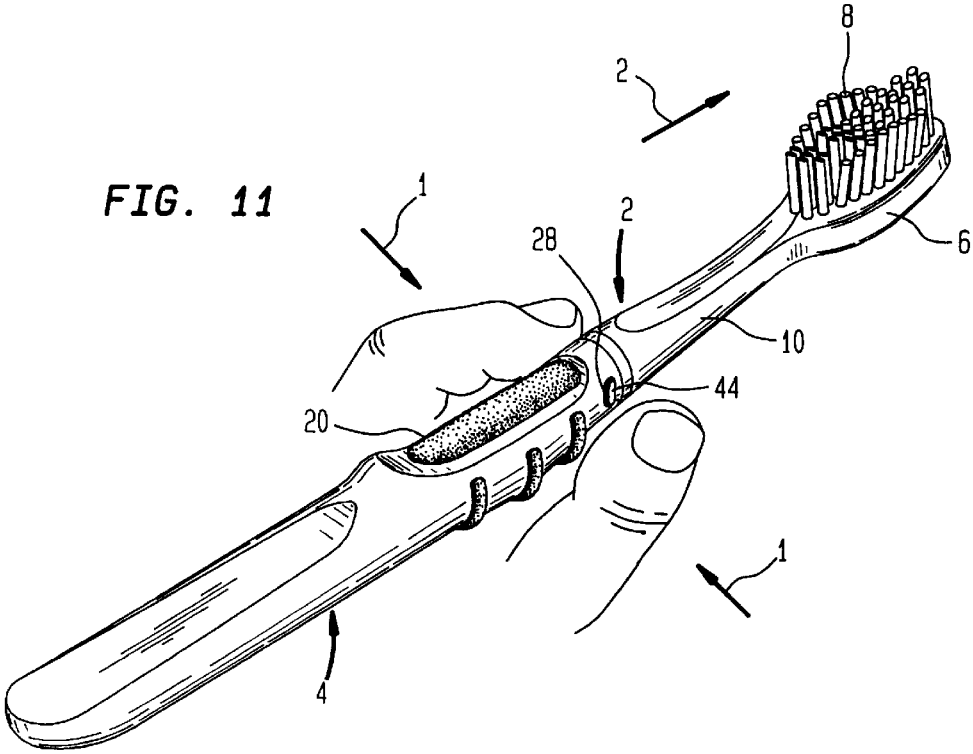
FIG. 11 demonstrates release of the coupling anchor to separate replaceable head from handle.

Insertion of a replaceable head is shown in FIG. 10. Neck 10 is directed by a user into cavity 24 with the neck coupling anchor lockingly being received within the complementary disengaging mechanism of the hollow collar. A nib 46 on body portion 12 is insertable into slot 48 and assists in the proper orientation for docking the replaceable head into the cavity. Docking is completed when the wings 14 on body portion 12 snap outward allowing a front edge 49 of wings 14 to engage surface 50 (see FIGS. 2 and 9). FIG. 11 illustrates the release/disengagement of the replaceable head. This is accomplished by finger action onto the pair of pins 44 which in turn press upon spring leaves 40 causing wings 14 to move inwardly and thereby allowing their normally blocking action to be overridden.

As an alternative to nib 46 and slot 48, the second end of the neck in cross-section is round except for a tangential flat segment. The flat segment will serve as the orientation determination structure. The flattened end fits complementarily into cavity 24, the cavity in cross-section being round except for a straight (flat) side.

Further, it is contemplated that brushhead 2 may be sold separately in commerce as a refill. Thus, handle 4 may be recycled while over time brushheads 2 will be replaced.

The present invention may be embodied in other specific forms without departing from its spirit or essential characteristics. The described embodiments are to be considered in all respects only as illustrative and not restrictive. The scope of the invention is, therefore, indicated by the appended claims rather than the foregoing description. All changes which come within the meaning and range of equivalency of the claims are to be embraced by their scope.

What is claimed is:

1. A replaceable head toothbrush comprising:

(i) a handle with a cavity at its first end;

(ii) a brushhead comprising a base, bristle tufts projecting from the base and a neck extending lengthwise from the base, the neck having a coupling anchor for engaging the handle, the neck having first and second ends with the coupling anchor terminating at the second end; and (iii) a collar with outer walls forming a hollow center and with a disengaging mechanism which lockingly receives the neck coupling anchor of the brushhead, and the collar being securingly lodged within the cavity at the first end of the handle.

2. The toothbrush according to claim 1 wherein the neck coupling anchor further comprises a body portion with a pair of outwardly flexible wings.

3. The toothbrush according to claim 2 wherein the wings are rectangular and connected to the body on only a single side of their rectangular shape.

4. The toothbrush according to claim 3 wherein the wings flare outwardly from the second end of the neck toward the bristle tufts.

5. The toothbrush according to claim 1 wherein the neck further comprises a nib and the collar further comprises a slot on an inner wall, the nib and slot being engageable to properly orient the neck and collar.

6. The toothbrush according to claim 1 wherein the disengaging mechanism of the collar comprises a pair of outwardly flexible spring leaves.

7. The toothbrush according to claim 6 wherein the spring leaves are rectangularly shaped and connected to the walls of the collar on only a single side of the rectangular shape.

8. The toothbrush according to claim 7 wherein each spring leaf includes a pin formed on an end thereof oriented at a right angle to the leaf.

9. The toothbrush according to claim 7 wherein the handle includes a pair of apertures traversing walls of the handle and the respective pins of the collar protrude through the apertures.

10. (Amended) A replaceable brushhead comprising:

(i) a base;

(ii) bristle tufts projecting from the base;

(iii) a neck extending lengthwise from the base; and (iv) a coupling anchor for engaging the handle, the neck having first and second ends with the coupling anchor terminating at the second end, the coupling anchor further comprising a body portion with a pair of outwardly flexible wings, the wings being rectangular and connected to the body on only a single side of their rectangular shape, and the wings flaring upwardly from the second end of the neck toward the bristle tufts.

* * * * *